US010208266B2

(12) United States Patent
Kaga et al.

(10) Patent No.: US 10,208,266 B2
(45) Date of Patent: Feb. 19, 2019

(54) WORKING FLUID

(71) Applicant: CCI CORPORATION, Seki-shi, Gifu (JP)

(72) Inventors: Nobuyuki Kaga, Seki (JP); Junichiro Kimura, Seki (JP)

(73) Assignee: CCI CORPORATION, Seki-Shi (JP)

( * ) Notice: Subject to any disclaimer, the term of this patent is extended or adjusted under 35 U.S.C. 154(b) by 0 days.

(21) Appl. No.: 14/224,943

(22) Filed: Mar. 25, 2014

(65) Prior Publication Data

US 2014/0323371 A1 Oct. 30, 2014

(30) Foreign Application Priority Data

Mar. 29, 2013 (JP) ..... 2013073464

(51) Int. Cl.
*C10M 105/14* (2006.01)
*C10M 107/50* (2006.01)
*C10M 169/04* (2006.01)

(52) U.S. Cl.
CPC ..... *C10M 107/50* (2013.01); *C10M 169/041* (2013.01); *C10M 105/14* (2013.01); *C10M 2207/0225* (2013.01); *C10M 2207/0406* (2013.01); *C10M 2209/1033* (2013.01); *C10M 2209/1045* (2013.01); *C10M 2215/044* (2013.01); *C10M 2215/223* (2013.01); *C10M 2227/003* (2013.01); *C10N 2230/06* (2013.01); *C10N 2240/08* (2013.01)

(58) Field of Classification Search
CPC ..... C10M 2227/02; C10M 2227/04; C10M 2229/04
USPC ..... 508/202, 204
See application file for complete search history.

(56) References Cited

U.S. PATENT DOCUMENTS

| | | | | |
|---|---|---|---|---|
| 3,234,252 | A | 2/1966 | Pater | |
| 3,457,173 | A | 7/1969 | Pater | |
| 4,420,409 | A | 12/1983 | Fukano et al. | |
| 2004/0147408 | A1 | 7/2004 | Kollin | |
| 2009/0088349 | A1 | 4/2009 | Zhao et al. | |
| 2010/0137174 | A1* | 6/2010 | Maeda | C10M 133/44 508/279 |
| 2011/0113699 | A1 | 5/2011 | Tanii et al. | |
| 2011/0207636 | A1 | 8/2011 | Zhao | |

FOREIGN PATENT DOCUMENTS

| | | | |
|---|---|---|---|
| JP | S41016289 | B | 9/1966 |
| JP | S57070196 | A | 4/1982 |
| JP | S61264097 | A | 11/1986 |
| JP | H10-036869 | A | 2/1998 |
| JP | 2010-540728 | A | 12/2010 |
| JP | 2011225661 | A | 11/2011 |
| WO | 2010/053641 | A1 | 5/2010 |

OTHER PUBLICATIONS

ShinEtsu, Reactive and Non-Reactive Modiifed Silicone Fluid, 2006.*

Extended European Search Report (EESR) dated Jun. 23, 2014, issued in corresponding European Application No. EP14161963.5.

Notification of Reasons for Refusal issued by the Japanese Patent Office, dated Sep. 20, 2016, for Japanese counterpart application No. 2013-073464.

* cited by examiner

*Primary Examiner* — Vishal V Vasisth
(74) *Attorney, Agent, or Firm* — Law Office of Katsuhiro Arai

(57) ABSTRACT

A working fluid whose base material is a glycol, characterized in that such working fluid contains a modified silicone oil.

4 Claims, No Drawings

WORKING FLUID

The present application claims priority to Japanese Patent Application No. 2013-073464, filed Mar. 29, 2013, the disclosure of which is incorporated herein by reference in its entirety.

FIELD OF THE INVENTION

The present invention relates to a working fluid whose base material is a glycol.

DESCRIPTION OF THE RELATED ART

Fluid-pressure operated automobile brake systems are based on a mechanism whereby sliding of the master cylinder piston causes fluid pressure to be transmitted to the wheel cylinder. Traditionally this cylinder component comprises a cylinder, piston, rubber cup, and other parts, each made of aluminum, cast iron, steel or other metal, or rubber.

In recent years, these parts are made of plastics, instead of metals, to help reduce the weight of the vehicle.

However, generally the lubrication property between plastics and rubber is worse than the lubrication property between metal and rubber, and this gives rise to a problem of abnormal noise caused by stick-slip.

Accordingly, Patent Literature 1 describes combining phosphate ester and fatty acid as brake fluid to improve lubrication property. Although lubrication property tends to improve as the number of carbons of fatty acid increases, however, achieving sufficient lubrication property is difficult.

Also, Patent Literature 2 describes an automobile brake fluid containing a mixture of phosphate esters expressed by the general formulas $(RO)_2P(O)OH$ and $(RO)P(O)(OH)_2$, and a glycol, where such automobile brake fluid is claimed to have the effect of lowering the friction coefficient and preventing scratching of the sliding surface, but it is not intended to prevent occurrence of stick-slip.

Patent Literature 3 describes blending a phosphate ester in brake fluid, but the specific phosphate esters mentioned include ethyl phosphate, dimethyl phosphate, etc., and those having a repeated structure of ethylene oxide or propylene oxide are not used, and the blending is not intended to prevent occurrence of stick-slip.

Additionally, none of these working fluids contains silicone oil.

BACKGROUND ART LITERATURES

[Patent Literature 1] WO2010/053641

[Patent Literature 2] Japanese Patent Laid-open No. Hei 10-36869

[Patent Literature 3] Published Japanese Translation of PCT International Patent Application No. 2010-540728

SUMMARY

An object of the present invention is to provide a working fluid that offers improved lubrication property as manifested by preventing occurrence of stick-slip as well as improved cold resistance.

The present invention includes the following embodiments:

1. A working fluid whose base material is a glycol and which contains a modified silicone oil having a polar group.

2. A working fluid according to 1, wherein the polar group is an amino group, epoxy group, methacrylic group, polyether group, mercapto group, carboxyl group, or hydroxy group.

3. A working fluid according to 1 or 2, wherein the modified silicone oil has a structure expressed by Formula (1).

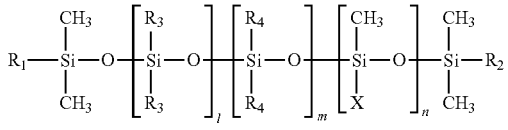

(1)

X: Polar group $R_1$, $R_2$: Group selected from among an alkyl group or alkoxy group with 1 to 30 carbon atoms, polar group identical to X above, and alkyl group or alkoxy group with 1 to 30 carbon atoms and having the polar group denoted by X above $R_3$, $R_4$: Methyl group or phenyl group l, m, and n are all 1 or greater, and l+m+n is 2000 or less.

4. A working fluid according to any one of 1 to 3, wherein the modified silicone oil has a polyether group being a polar group, and another polar group other than the polyether group.

5. A working fluid according to 4, wherein the other polar group is an amino group, epoxy group, methacrylic group, mercapto group, carboxyl group, or hydroxy group.

6. A working fluid according to any one of 1 to 5, characterized in that the content of the modified silicone oil is 0.002 to 1.0 percent by weight.

7. A working fluid according to any one of 1 to 6, containing one or more types selected from among rustproof agent, antioxidant, and pH adjustment agent.

According to the present invention, lubrication property of working fluid can be improved by preventing occurrence of stick-slip.

DETAILED DESCRIPTION OF EMBODIMENTS (Purpose of Use of the Working Fluid Proposed by the Present Invention)

The working fluid proposed by the present invention can be used as a fluid pressure actuation fluid, such as automobile brake fluid, clutch fluid, working fluid for cylinders used in various industrial equipment, or any other hydraulic pressure transmission medium.

The present invention is described specifically below.

(Glycol)

Under the present invention, a glycol constitutes the base material of working fluid.

Examples of this glycol include monoethylene glycol, diethylene glycol, triethylene glycol, polyethylene glycol (n=4 or more, for example), diethylene glycol monomethyl ether, triethylene glycol monomethyl ether, tetraethylene glycol monomethyl ether, polyethylene glycol monomethyl ether (n=5 or more), diethylene glycol monoethyl ether, triethylene glycol monoethyl ether, tetraethylene glycol monoethyl ether, polyethylene glycol monoethyl ether (n=5 or more), diethylene glycol monopropyl ether, triethylene glycol monopropyl ether, tetraethylene glycol monopropyl ether, polyethylene glycol monopropyl ether (n=5 or more), diethylene glycol monobutyl ether, triethylene glycol monobutyl ether, tetraethylene glycol monobutyl ether, polyethylene glycol monobutyl ether (n=5 or more), triethylene glycol monohexyl ether, dipropylene glycol monomethyl ether, dipropylene glycol monopropyl ether, dipropylene glycol monobutyl ether, tripropylene glycol monomethyl ether, tripropylene glycol monoethyl ether, tripropylene glycol monopropyl ether, dipropylene glycol monobutyl ether, tripropylene glycol monobutyl ether, polypropylene glycol monobutyl ether, and polypropylene glycol monopropyl ether, which may be used alone or two or more of the foregoing may be combined and used.

Among others, a preferred glycol component is at least one type selected from a group that includes combinations (such as mixtures) of diethylene glycol, triethylene glycol, polyethylene glycol (n=4 or more, for example), triethylene glycol monomethyl ether, tetraethylene glycol monomethyl ether, polyethylene glycol monomethyl ether (n=5 or more), triethylene glycol monoethyl ether, triethylene glycol monopropyl ether, triethylene glycol monobutyl ether, tetraethylene glycol monobutyl ether, and polyethylene glycol monobutyl ether (n=5 or more).

In addition, the above glycols may be borate esters thereof. Examples of borate esters of glycols include borate esters of triethylene glycol monomethyl ether, tetraethylene glycol monomethyl ether, polyethylene glycol monomethyl ether (n=5 or more), triethylene glycol monoethyl ether, triethylene glycol monopropyl ether, triethylene glycol monobutyl ether, tetraethylene glycol monobutyl ether, and polyethylene glycol monobutyl ether (n=5 or more), which may be used alone or two or more of the foregoing may be combined and used.

(Polyol)

In addition to the above glycols, other polyol may be added.

Examples of this polyol include polyether polyol. The content of this polyol in the working fluid is 0 to 30 percent by weight.

(Other Base Materials that can be Blended in)

Other base materials that can be blended in include water and alcohol, for example.

Examples of alcohol include monovalent alcohol and polyvalent alcohol. Examples of monovalent alcohol include methanol, ethanol, 1-propanol, 1-butanol, 2-butanol, 3-butanol, and 2-methyl-2-butanol. Examples of polyvalent alcohol include glycol and glycerin. Examples of glycol include monoethylene glycol, propylene glycol, 1,3-butylene glycol, hexylene glycol, and diethylene glycol.

The modified silicone oil used under the present invention is expressed by Formula (1) below:

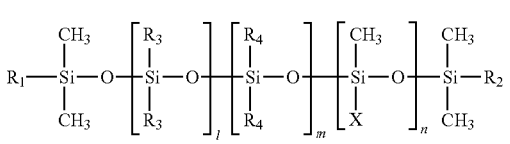

(1)

X: Polar group $R_1$, $R_2$: Group selected from among an alkyl group or alkoxy group with 1 to 30 carbon atoms, polar group identical to X above, and alkyl group or alkoxy group with 1 to 30 carbon atoms and having the polar group denoted by X above $R_3$, $R_4$: Methyl group or phenyl group l, m, and n are all 1 or greater, and l+m+n is 2000 or less.

In the modified silicone oil expressed by Formula (1) above, X represents a polar group, and one or more types selected from among an amino group, epoxy group, methacrylic group, polyether group, mercapto group, carboxyl group, and hydroxy group may be contained.

Among others, preferably X is an amino group, epoxy group, polyether group, or combination of polyether group and amino group.

Also, X may be a group constituted by any of the above polar groups directly bonding with a silicon atom, or by any of the above polar groups bonding with an amino alkyl group, amino phenyl group, hydroxy ethyl group, or other hydrocarbon group.

In the modified silicone oil expressed by Formula (1) above, $R_1$ and $R_2$ may be same or different, each selected from among an alkyl group or alkoxy group, group having the polar group denoted by X above, and alkyl group or alkoxy group with 1 to 30 carbon atoms and having the polar group denoted by X above.

It should be noted that the "polar group denoted by X above" refers to a polar group joined via an alkylene group, etc., not directly bonding with a silicon atom.

Thus, the alkyl group or alkoxy group has 1 to 30 carbon atoms and may be substituted by a group that can be contained in the polar group denoted by X above.

In the modified silicone oil expressed by Formula (1) above, $R_1$ and $R_2$ may be the polar group denoted by X above.

Additionally, in the modified silicone oil expressed by Formula (1) above, $R_3$ and $R_4$ may be same or different, each representing a methyl group or phenyl group.

For such silicone oil, X22-3939A (X: Amino group and polyether group; R1 to R4: Methyl group), X22-2000 (X: Epoxy group; R1, R2: Methyl group, R3, R4: One is a phenyl group, while the other is a methyl group) or KF-393 (X: Amino group; R1 to R4: Methyl group) manufactured by Shin-Etsu Chemical can be used, among others.

In addition, such modified silicone oil is added to the working fluid preferably by 0.002 to 1.0 percent by weight, or more preferably by 0.005 to 0.7 percent by weight, or even more preferably by 0.01 to 0.3 percent by weight.

If the modified silicone oil is added to the working fluid by less than 0.002 percent by weight, lubrication performance cannot be improved fully and stick-slip will occur. On the other hand, adding the modified silicone oil by more than 1.0 percent by weight will not improve lubrication performance or cold resistance further.

(Other Additives)

Depending on its application, etc., the working fluid proposed by the present invention can contain one or more types selected from among lubricant, wear-proof agent, viscosity adjustment agent, bactericide, defoaming agent, rustproof agent, antioxidant, extreme-pressure agent, pH adjustment agent, and dye.

EXAMPLES

Working fluids of Examples 1 to 4 of the present invention, and of Comparative Examples 1 to 3, were prepared according to the compositions described in Table 1 below, and the stick-slip occurrence test was conducted on these working fluids.

The compositions of working fluids used in these Examples and Comparative Examples, and test results thereof, are shown in Table 1 below. The values in Table 1 indicate parts by weight.

(Stick-Slip Occurrence Test)

Using Tribogear 14FW manufactured by Shinto Scientific, polyamide resin and rubber sheets were soaked in a brake fluid to evaluate whether or not stick-slip (rattling noise) would occur between the two, at a slip speed of 700 mm/min and by applying a vertical load of 10 N. By checking whether or not stick-slip occurs, whether lubrication performance is good or not can be checked.

TABLE 1

| Compositions | Example 1 | Example 2 | Example 3 | Example 4 | Comparative Example 1 | Comparative Example 2 | Comparative Example 3 |
|---|---|---|---|---|---|---|---|
| Triethylene glycol monomethyl ether | 50 | 50 | 50 | 50 | 50 | 50 | 50 |
| Polyethylene glycol monomethyl ether | 30 | 30 | 30 | 30 | 30 | 30 | 30 |
| Tetraethylene glycol monomethyl ether | 10 | 10 | 10 | 10 | 10 | 10 | 10 |
| Polyether polyol | 8 | 8 | 8 | 8 | 8 | 8 | 8 |
| Diethylene glycol | 2 | 2 | 2 | 2 | 2 | 2 | 2 |
| Modified silicone oil A | 0.1 | 0.005 | — | — | — | — | — |
| Modified silicone oil B | — | — | 0.1 | — | — | — | — |
| Modified silicone oil C | — | — | — | 0.1 | — | — | — |
| Silicone oil A | — | — | — | — | — | 0.1 | — |
| Silicone oil B | — | — | — | — | — | — | 0.1 |
| Benzotriazol | 0.4 | 0.4 | 0.4 | 0.4 | 0.4 | 0.4 | 0.4 |
| Dicyclohexyl amine | 0.4 | 0.4 | 0.4 | 0.4 | 0.4 | 0.4 | 0.4 |
| Stick-slip occurrence | Did not occur | Did not occur | Did not occur | Did not occur | Occurred | Occurred | Occurred |

Modified silicone oil A: X22-3939A (amino and polyether-modified silicone oil) manufactured by Shin-Etsu Chemical Modified silicone oil B: X22-2000 (epoxy-modified silicone oil) manufactured by Shin-Etsu Chemical Modified silicone oil C: KF-393 (amino-modified silicone oil) manufactured by Shin-Etsu Chemical Silicone oil A: KF-96-100CS manufactured by Shin-Etsu Chemical Silicone oil B: KF-96-5000CS manufactured by Shin-Etsu Chemical As shown in Table 1, stick-slip did not occur in the working fluids of Examples 1 to 4 to which modified silicone oil had been added, and it can be confirmed that these working fluids possess good lubrication performance.

However, stick-slip occurred in the working fluid of Comparative Example 1 having the same composition as in Examples 1 to 4 except that no modified silicone oil had been added, and it can be confirmed that its lubrication performance is not good.

As in the working fluid of Comparative Example 1, stick-slip also occurred in the working fluids of Comparative Examples 2 and 3 to which non-modified silicone oil A or B had been added instead of modified silicone oil, and it can be confirmed that their lubrication performance is not good, either.

Based on the above results, the present invention is not characterized by a simple addition of any silicone oil to a working fluid whose base material is a glycol, but it is necessary to select and add a modified silicone oil.

We claim:

1. A working fluid whose base material is constituted by triethylene glycol monomethyl ether and further comprising polyethylene glycol monomethyl ether, tetraethylene glycol monomethyl ether, and combinations thereof; and which contains a modified silicone oil having a polar group, wherein the polar group is constituted only by an amino group and a polyether group, wherein the modified silicone oil has a structure expressed by Formula (1):

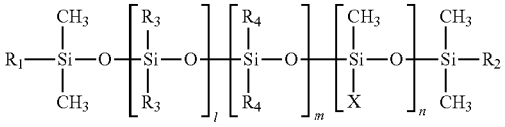

(1)

X: Polar group;

$R_1$, $R_2$: Group selected from among an alkyl group or alkoxy group with 1 to 30 carbon atoms, polar group identical to X above, and alkyl group or alkoxy group with 1 to 30 carbon atoms and having the polar group denoted by X above;

$R_3$, $R_4$: Methyl group or phenyl group;

l, m, and n are all 1 or greater, and l+m+n is 2000 or less, and wherein the content of the modified silicone oil is 0.002 to 0.7 percent by weight, said working fluid containing one or more additives selected from among lubricant, wear-proof agent, viscosity adjustment agent, bactericide, rustproof agent, antioxidant, extreme-pressure agent, pH adjustment agent, dye, and defoaming agent.

2. A working fluid according to claim 1, which contains at least one of antioxidant and pH adjustment agent.

3. A working fluid according to claim 1, which contains one or more types selected from among rustproof agent, antioxidant, and pH adjustment agent.

4. A working fluid according to claim 1, which is an anti-stick-slip working fluid.

* * * * *